United States Patent [19]

Cooper

[11] Patent Number: 4,498,654

[45] Date of Patent: Feb. 12, 1985

[54] SUPPORT FOR BATHROOM FIXTURE OR THE LIKE

[75] Inventor: Leo Cooper, Los Angeles, Calif.

[73] Assignee: Tubular Specialties Mfg., Inc., Los Angeles, Calif.

[21] Appl. No.: 384,548

[22] Filed: Jun. 3, 1982

[51] Int. Cl.[3] ..... A47H 1/14

[52] U.S. Cl. ..... 248/251; 248/262

[58] Field of Search ..... 248/251, 254, 255, 262, 248/263, 279, 298; 285/46

[56] References Cited

U.S. PATENT DOCUMENTS

| | | | |
|---|---|---|---|
| 1,156,076 | 10/1915 | Henry | 248/262 |
| 1,196,704 | 8/1916 | Kroder | 248/262 |
| 2,682,385 | 6/1954 | Schluter | 248/262 |
| 2,715,468 | 8/1955 | Waltz | 248/251 |
| 2,956,767 | 10/1960 | Unetic | 248/251 |
| 3,260,021 | 7/1966 | Katz | 248/251 |
| 4,385,777 | 5/1983 | Logsdon | 285/46 |

*Primary Examiner*—William H. Schultz
*Assistant Examiner*—Ramon O. Ramirez
*Attorney, Agent, or Firm*—William P. Green

[57] ABSTRACT

A support for a towel rack or other fixture including a mounting plate adapted to be attached by a fastener or fasteners to a supporting wall, a post supported by the mounting plate and projecting outwardly therefrom and which is of non-circular external cross-section, a cover plate disposed about the non-circular post outwardly of the mounting plate and containing an opening through which the post extends in a loosely fitting relation allowing the cover plate to be shifted transversely of the post during assembly of the parts in order to allow access of a tool to the attaching screws, with an additional part being disposed about the post and fitting closely thereon and acting to bridge across the space between the post and the cover plate in the assembled condition of the fixture.

20 Claims, 9 Drawing Figures

SUPPORT FOR BATHROOM FIXTURE OR THE LIKE

BACKGROUND OF THE INVENTION

This invention relates to improved arrangements for attaching a towel rack or other bathroom fixtures or the like to a supporting wall surface.

Devices embodying the invention are of a general type including a mounting plate which is attached to a supporting wall by screws or other fasteners, with a post projecting outwardly from the mounting plate in the assembled condition of the device to support an outer structure such as a towel rack bar, soap dish, tissue dispenser, or the like. Some conventional residential bathroom fixtures of this type include a cover plate which is attached to the post and is received in front of the mounting plate in the assembled condition of the fixture to shield the fasteners from view and prevent unwanted access thereto. The cover plate and attached post have usually been detachably connectable to the mounting plate by tightening of a set screw carried by an edge portion of the cover plate against a peripheral portion of the mounting plate. The act of tightening such a set screw, however, is very inconvenient and time consuming and constitutes a substantial labor cost factor in residential construction when a particular home may have several rooms each containing a number of fixtures requiring mounting in this tedious manner.

Another prior arrangement utilizes posts which are of circular cross-section, with the cover plate being formed separately from the post and adapted to be turned about it to a position allowing a screw driver to be inserted past the cover plate and into engagement with the mounting screws. However, such circular posts are not considered acceptable by many persons, who prefer a post of rectangular cross-section.

SUMMARY OF THE INVENTION

A major purpose of the present invention is to provide a fixture mounting assembly which can be attached to a wall as quickly and easily as the second of the above discussed types of prior devices, without the tedious set-screw type of retention, and which in addition is not limited to use of a post of circular cross section, but instead may utilize a post or posts of rectangular or other non-circular section. An assembly embodying the invention includes a combination of parts which can be moved to positions allowing access of a screw driver or other tool to an attaching fastener or fasteners during the mounting operation, and which after tightening of the fasteners can be quickly shifted to final positions covering those fasteners and presenting a neat and attractive external appearance.

The assembly includes a mounting plate attachable by screws or other fasteners to a wall, a post of non-circular external cross-section supported by and projecting outwardly from the mounting plate, and a cover plate which is disposed about the non-circular post and contains an opening within which the post is received but which is larger than the post giving the cover plate a loose fit on the post enabling it to be shifted transversely of the post to positions allowing access of a tool to the screws by which the mounting plate is secured to the wall. In addition to these parts, the device includes another part which is received about the post and which in the final assembled condition of the fixture acts to bridge across the space between the post and the cover plate, to close that space. This additional part contains a non-circular opening within which the post is received in closely fitting relation, so that the part does not move laterally with the cover plate when the latter is shifted transversely to allow tightening of the screws. After the screws have been tightened to secure the mounting plate to the wall, the cover plate may be moved to a position encircling the mounting plate, and engage the mounting plate in a detenting relation holding the parts in assembled condition.

BRIEF DESCRIPTION OF THE DRAWINGS

The above and other features and objects of the invention will be better understood from the following detailed description of the typical embodiments illustrated in the accompanying drawings in which.

DESCRIPTION OF THE PREFERRED EMBODIMENTS

Figure 1:
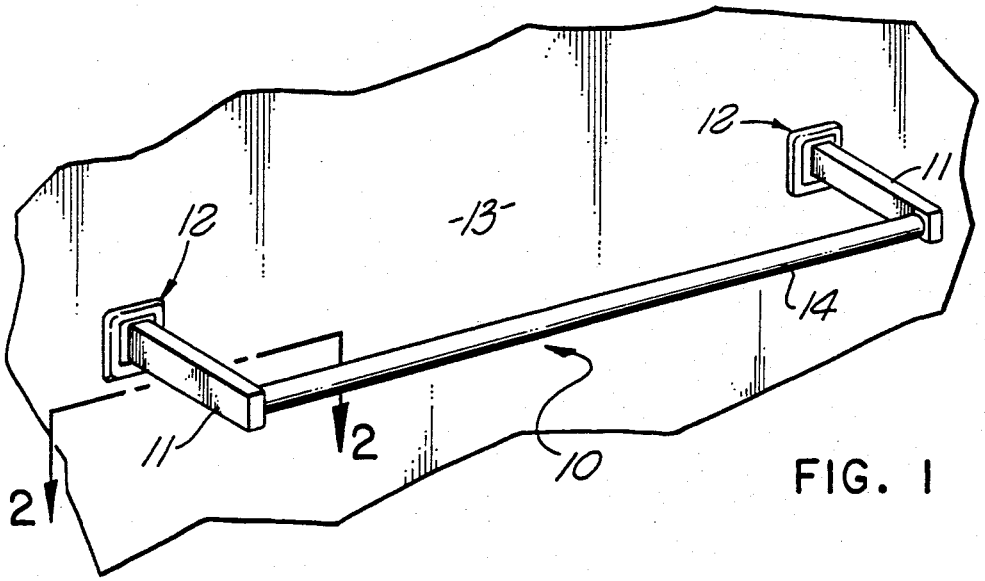
FIG. 1 is a perspective view of a towel rack constructed in accordance with the invention.

The towel rack 10 illustrated in FIG. 1 includes two posts 11 attached by two mounting assemblies 12 to a wall 13, and projecting outwardly from the wall to outer ends of the posts between which a towel bar 14 extends horizontally. In lieu of the towel bar 14, one or more of the posts may carry any other supported structure, such as a soap dish, cup holder, tissue dispenser, or the like.

The assembly 12 for attaching each of the posts to wall 13 includes a mounting plate 15 which is essentially flat and secured to the wall by two screws 16 extending through openings 17*a* and 17*b* in opposite side portions of the mounting plate. As will be understood, the shanks of fasteners 16 are screwed into the material of wall 13, and the enlarged diameter heads 18 of the fasteners containing screwdriver slots 19 bear against mounting plate 15 about openings 17*a* and 17*b* to tighten the plate inwardly toward the wall.

Figure 5:
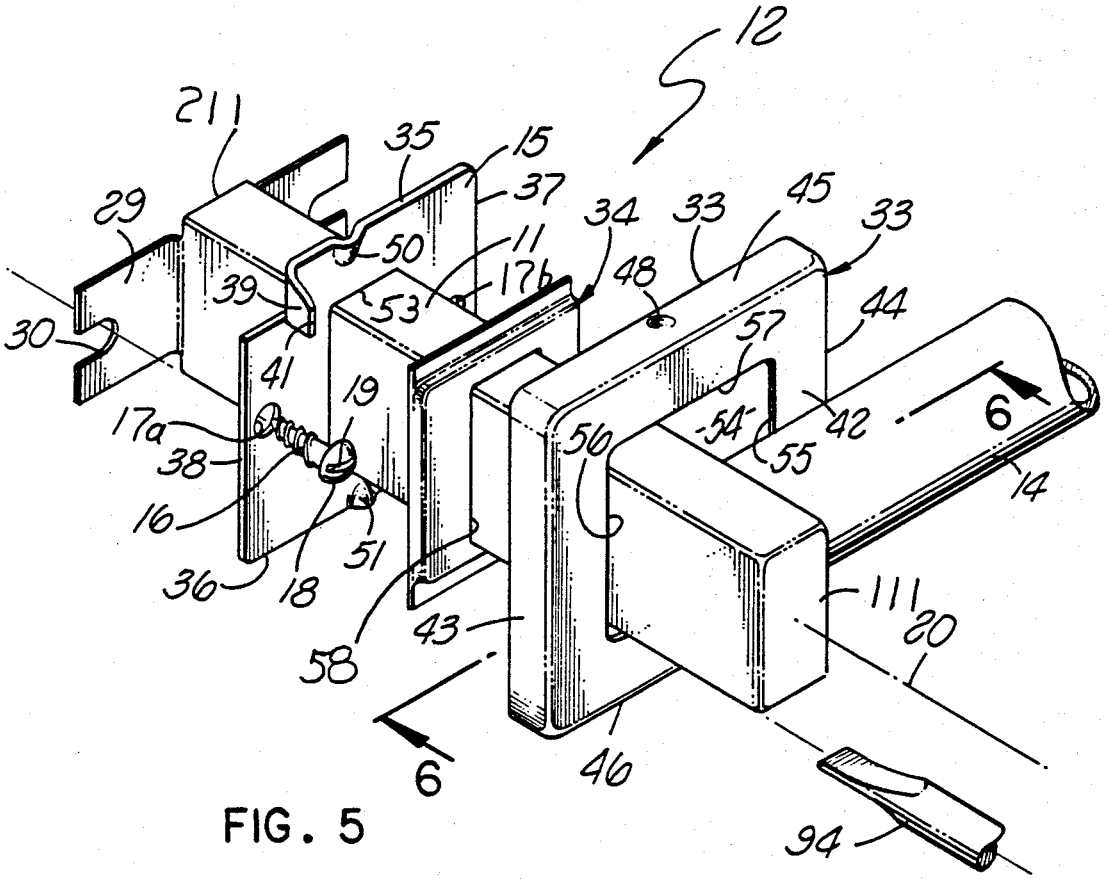
FIG. 5 is an exploded perspective representation of one of the mounting assemblies of the towel rack.
Figure 4:
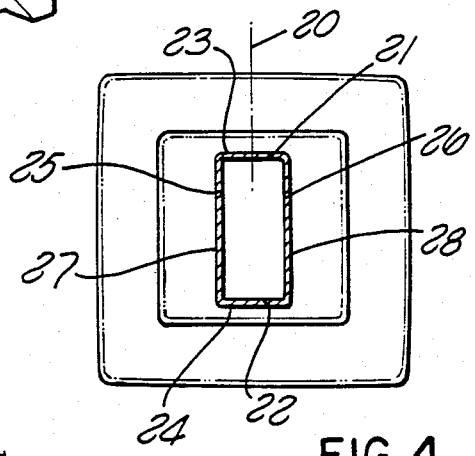
FIG. 4 is a view taken on line 4—4 of FIG. 3.

Each post 11 projects from wall 13 along a typically horizontal axis 20, with the axes of the two posts desirably being parallel to one another, and with each post being of non-circular external cross-section transversely of its axis 20. As seen in FIG. 4, each post is preferably of rectangular external cross-section transversely of axis 20, having two top and bottom walls 21 and 22 with parallel horizontal upper and lower surfaces 23 and 24, and having opposite side walls 25 and 26 with parallel vertical outer side surfaces 27 and 28. This rectangular configuration of the post continues through its entire length from an outer vertical end wall 111 of the post to its inner extremity 211 received adjacent wall 13 in the mounted condition of the fixture. At the inner extremity of the post, its vertical opposite side walls 25 and 26 may have end portions 29 turned laterally perpendicular to axis 20 and in opposite directions for reception between mounting plate 15 and the wall surface 13 in a relation confining the portions or tabs 29 in fixed positions and thereby holding the post rigidly in its outwardly projecting condition when screws 16 are tightened into the wall. As seen in FIG. 5, the mounting tabs 29 of the post may contain slots or openings 30 through which screws 16 extend. At their outer extremities, posts 11 may be shaped to receive and support towel bar 14, or another supported structure, as by provision of a circular opening 31 in one of the side walls 26 dimensioned to exactly receive and effectively locate the typically correspondingly circular towel bar 14, with the end 32 of the towel bar projecting into close proximity to or engaging the other side wall 25. After the towel rack has been completely assembled, mounting plate 15 and screws 16 are shielded from view and from unwanted tampering or removal by a cover plate 33 and an additional plate or part 34 bridging the space between the cover plate and post. The cover plate has an external outline configuration transversely of axis 20 corresponding approximately to and slightly larger than mounting plate 15, to extend about that plate. In the particular arrangement illustrated in the drawing, mounting plate 15 is externally approximately square, being defined by two upper and lower parallel horizontal edges 35 and 36 and two parallel vertical opposite side edges 37 and 38, with portions of the material of plate 15 near its upper lefthand corner and lower righthand corner being deformed forwardly to form lugs or projections 39 and 40 having vertical forward edges 41 engageable with part 34 in locating relation in the assembled condition of the device.

Figure 2:
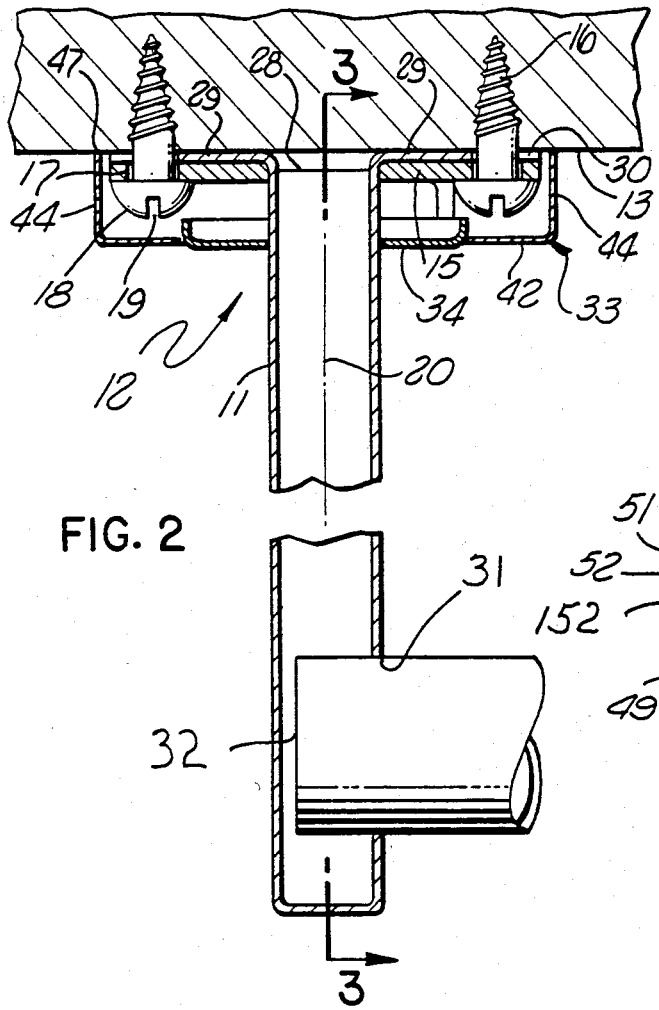
FIG. 2 is an enlarged fragmentary horizontal section taken on line 2—2 of FIG. 1.
Figure 3:
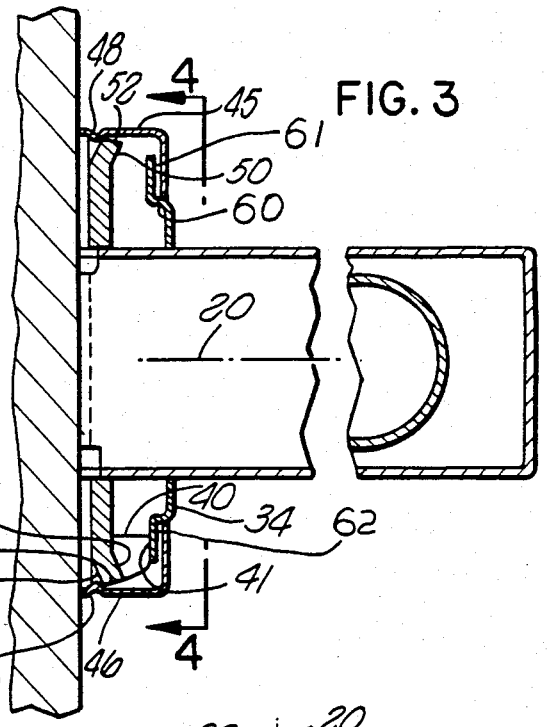
FIG. 3 is a vertical section taken on line 3—3 of FIG. 2.
Figure 6:
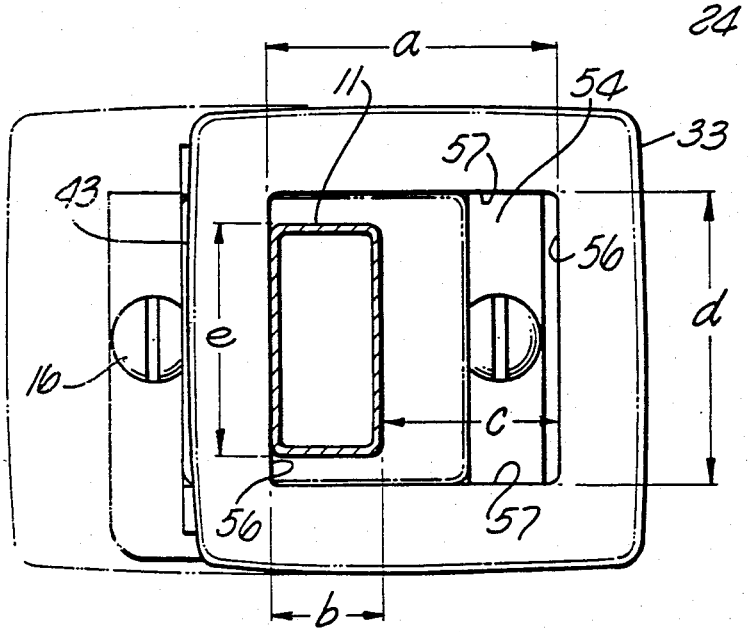
FIG. 6 is a view taken on line 6—6 of FIG. 5.

To fit closely about this square mounting plate 15, the front cover plate 33 has a front wall 42 disposed vertically and transversely of axis 20 in the assembled condition, and which in that condition is spaced outwardly or forwardly of and parallel to mounting plate 15 as seen in FIGS. 2 and 3. Extending rearwardly from this front wall 42, cover plate 33 has peripheral walls received closely about the edges of mounting plate 15, and including two approximately parallel and approximately vertical side walls 43 and 44 and two approximately parallel and approximately horizontal top and bottom walls 45 and 46, with each of these walls typically being bowed very slightly outwardly at its center as seen in FIG. 6. Peripheral walls 43, 44, 45 and 46 of cover plate 33 have rear edges 47 lying in a common plane transversely of axis 20 in order to simultaneously and continuously engage the flat wall surface 13 in the mounted condition of the device. The cover plate is retained in this assembled condition by detented connection to mounting plate 15, and more particularly by provision of dimples or indentations 48 and 49 formed in top and bottom walls 45 and 46 of the cover plate and functioning as lugs projecting inwardly toward axis 20, with the walls 45 and 46 having sufficient resilience to enable these detent lugs 48 to be deflected slightly away from axis 20 and then return resiliently inwardly toward that axis as the lugs pass the upper and lower edges respectively of mounting plate 15. For coaction with these detent lugs, the mounting plate has deformations 50 and 51 at the centers of its upper and lower edges, providing camming surfaces 52 which engage lugs 48 and 49 as the cover plate is moved rearwardly to deflect the lugs in a manner enabling them to pass portions 50 and 51, and having rear faces 152 then engageable with lugs 48 and 49 in a snap detent relation locking the cover plate to mounting plate 15 and against the wall.

Prior to attachment of the device to a wall surface, mounting plate 15 may be free for axial movement along post 11, but retained against movement transversely of axis 20 relative to the post. For this purpose, the mounting plate preferably contains a central opening 53 which is of non-circular cross-section correspondihg to the external cross-section of post 11, and which in the particular illustrated arrangement has the same rectangular cross-section as is defined by the outer surfaces of the post. Cover plate 33 also contains an opening 54 through which the post extends, but this opening is larger than the outer cross-sectional configuration of the post in order to allow movement of the cover plate transversely of axis 20 relative to the post. Opening 54 is defined by an inner edge 55 of the front wall 42 of the cover plate, with that edge preferably being approximately square and larger in both vertical and horizontal dimension than the mounting post, and more specifically being defined by two parallel vertical side edges 56 and two parallel horizontal top and bottom edges 57 of the opening. The relationship between the external size of the post and the size of opening 54 in the cover plate is represented in FIG. 6, which illustrates for example that the horizontal width a of opening 54 is greater than the horizontal external width b of post 11, with the difference between these two dimensions being represented at c. This loose fitting relationship of the post within opening 54 enables cover plate 33 to be moved laterally or horizontally relative to the post, and between the full line position of FIG. 6 and the broken line position of that figure. In the full line position, the cover plate is disposed far enough to the right to assure that its left side wall 43 is offset to the right of screw receiving opening 17*a* of the mounting plate, so that a screwdriver 94 can extend directly rearwardly and parallel to axis 20 along the left side of the cover plate and into engagement with a screw 16 extending through opening 17*a* and into the wall. Similarly in the leftwardly displaced position of the cover plate represented in broken lines in FIG. 6, the right side wall 44 of the cover plate is offset leftwardly of the right-hand opening 17*b* of mounting plate 15, so that a screwdriver may extend directly rearwardly and parallel to axis 20 past the right side wall 44 of the cover plate and into engagement with a screw connected into that second opening 17*b*, to tighten that screw into a wall surface. The vertical dimension d of opening 54 in the cover plate may also be greater than the vertical dimension e of the post, to similarly allow upward and downward displacement of the cover plate relative to the post if desired.

Part 34 is received about and movable axially along post 11, and contains a non-circular opening 58 dimensioned in correspondence with the external cross-sectional configuration of post 11 to fit closely thereabout in a manner preventing substantial movement of part 34 transversely of the post while permitting axial movement of part 34 relative to the post during assembly. Part 34 has a peripheral outline configuration which corresponds approximately to the opening 54 in cover plate 33, to close that opening in the assembled condition of the parts. Part 34 may be shaped to project forwardly into and fit closely within opening 54 to maintain parts 33 and 34 in proper cooperating relation. Except along its edges, part 34 may be essentially planar and lie within essentially the same plane as front wall 42 of cover plate 33, with the opposite side edges of part 34 being turned angularly rearwardly at 59 (FIG. 2) to engage the side edges 56 of opening 54 in locating relation. Similarly, as seen in FIG. 3, the material of part 34 may be turned angularly rearwardly at its upper and lower edges, as represented at 60, to engage the edges 57 of opening 54 in locating relation. Upwardly beyond the top one of these portions 60, the material of part 34 may be turned directly upwardly at 61 to engage the back surface of front wall 42 of cover plate 33, and similarly the lower edge portion 62 of part 34 may be turned directly downwardly to engage the back side of front wall 42 of cover plate 33, so that the cover plate in assembled condition holds part 34 rearwardly against the two previously described forwardly directed tabs or projections 39 and 40 of mounting plate 15, in a relation confining part 34 between projections 39 and 40 and the cover plate and thereby holding part 34 in fixed position.

To recapitulate briefly the procedure which is involved in mounting towel rack 10 on a wall surface, a first step may be to place one of the posts 11 and its mounting assembly 12 adjacent wall surface 13, pressing mounting plate 15 rearwardly toward the wall in a manner confining the attaching tabs 29 of the post between that mounting plate and the wall surface. One of the screws 16 is then inserted through an opening 17*a* or 17*b* in the mounting plate and the corresponding cutaway or opening 30 of one of the tabs 29, while the cover plate 33 is held in a position enabling a screwdriver to extend past the cover plate and to the screw. For example, the cover plate may be moved to the right in front of mounting plate 15 and to the full line position of FIG. 6 (see also FIG. 5), after which the screwdriver may be inserted rearwardly parallel to axis 20 past the left edge of cover plate 33 and into engagement with the left one of the two screws 16, and be turned to screw that fastener into the wall and to the FIG. 2 tightened position retaining the left side of the mounting plate in place. The cover plate 33 may then be moved leftwardly to the broken line position of FIG. 6, with the screwdriver then being inserted rearwardly parallel to axis 20 and past the right side of the cover plate to engage the second of the screws and advance it into the FIG. 2 installed condition relative to the wall. With the mounting plate 15 thus tightly retained in position, and with the post being held by the mounting plate, cover plate 33 is moved to a position in which it is centered with respect to the post, and is then moved rearwardly to the FIG. 2 position about the mounting plate. During such rearward movement, detents 48 and 49 snap resiliently past deformed portions 50 and 51 of the mounting plate, and to the FIG. 3 position in which the cover plate is effectively retained against the wall. In this position, the engagement of the cover plate about opening 54 with the periphery of part 34, and especially with the upper and lower edge portions 61 and 62, moves part 34 rearwardly to the position of FIGS. 2 and 3, in which it engages the two portions 39 and 40 of the mounting plate to be clamped in position as previously discussed. All of the parts are thus rigidly retained in fixed position, with the screws and mounting plate shielded from view. Both of the posts 11 are mounted in this manner, with transverse towel bar 14 extending therebetween, to complete the assembly.

Figure 7:
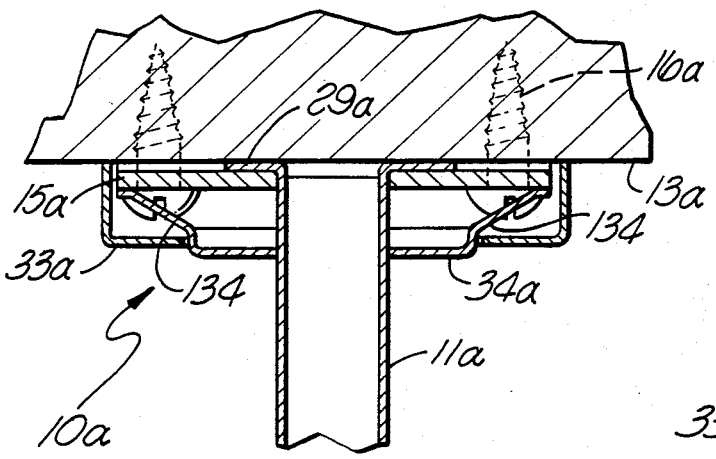
FIGS. 7, 8 and 9 are views similar to FIGS. 2, 5 and 6 respectively but showing a second form of the invention.
Figure 9:
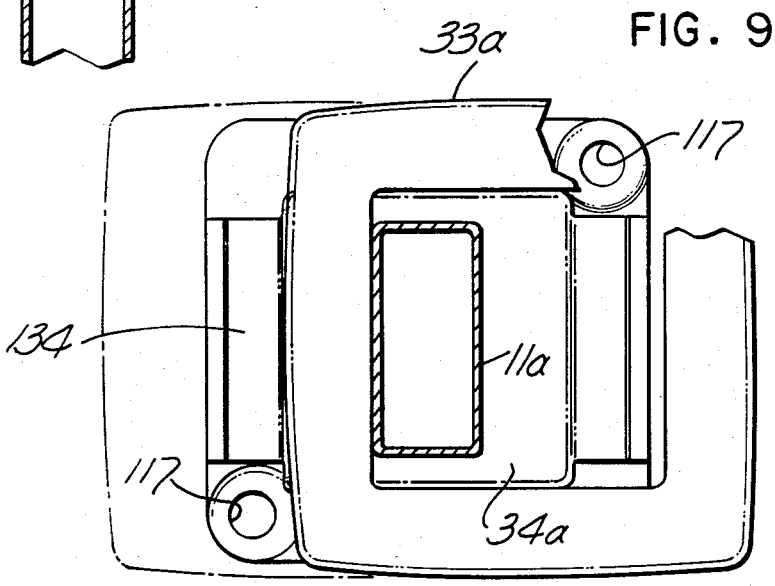
Figure 8:
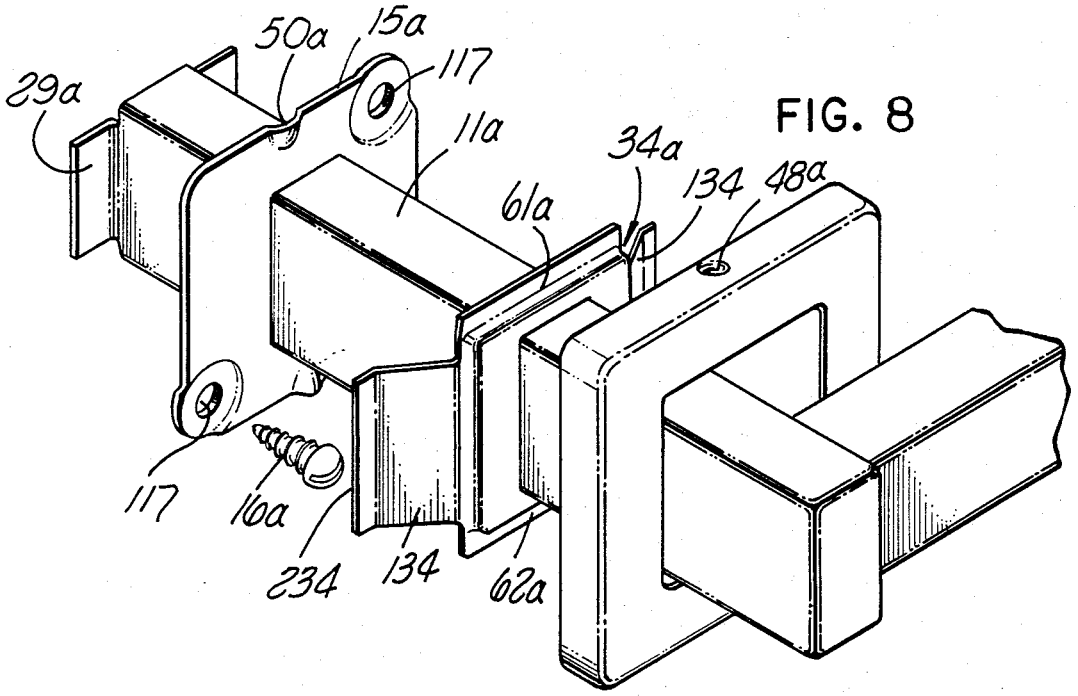

The variational form of the invention 10*a* illustrated in FIGS. 7 through 9 may be considered as identical with that of FIGS. 1 to 6 except with regard to the differences specifically discussed below. The FIGS. 7 through 9 arrangement includes a post 11*a* of rectangular cross-section corresponding to post 11 of the first form of the invention and having mounting tabs 29*a* turned laterally behind mounting plate 15*a* for retention thereby against wall surface 13*a*. The openings 117 in mounting plate 15*a* may be located in the corners of the mounting plate, rather than at the locations of the screw receiving openings of the first form of the invention. Tabs 29*a* in FIGS. 7 through 9 do not contain the screw passing notches 30 illustrated in FIG. 5.

Cover plate 33*a* may be identical with plate 33 of the first form, and may have detenting indentations 48*a* engageable with deformations 50*a* to lock the cover plate to the mounting plate in assembled condition. The inner part 34*a* for bridging across the gap between cover plate 33*a* and post 11*a* in the assembled condition may be identical with part 34 of FIGS. 1 through 6 except for provision of two locating tabs or fingers 134 formed from the sheet material from which part 34*a* is stamped and extending laterally and rearwardly at an angle as illustrated in FIG. 7 to rear side edges 234 of these tabs which in the assembled condition engage the front surfaces of mounting plate 15*a* to limit the extent to which the part 34*a* can be pressed rearwardly. These tabs 134 thus serve the function of projections 39 and 40 on the mounting plate 15 of the device of FIGS. 1 through 6, so that in the assembled condition of FIG. 7, the cover plate 33*a* presses rearwardly against the top and bottom portions 61*a* and 62*a* of part 34*a*, while the rear edges 234 of tabs 134 press rearwardly against mounting plate 15*a*, in a relation confining part 34 against either forward or rearward movement from its properly assembled position within the opening in cover plate 33*a*.

As in the first form of the invention, cover plate 33*a* can during mounting be moved laterally in either direction into engagement with post 11*a*, to expose first one of the openings 117 and a contained screw for advancement into the wall by a screwdriver, and then the second opening and its contained screw. FIG. 9 illustrates the cover plate in its rightwardly offset position to allow a screwdriver to pass rearwardly along the left side of the cover plate to advance a first screw into the lower left hand corner portion of the mounting plate. After this screw has been fully advanced into the wall, cover plate 33*a* can be moved leftwardly to a position corresponding to the broken line position of FIG. 6 to enable a second screw to be advanced by a screwdriver into the opening in the upper right hand corner of the mounting plate. After the mounting plate has thus been securely attached to the wall, cover plate 33*a* can be moved to a centered position with respect to post 11*a* and then moved rearwardly into detented engagement with the mounting plate for retention with part 34*a* in the assembled position.

While certain specific embodiments of the present invention have been disclosed as typical, the invention is of course not limited to these particular forms, but rather is applicable broadly to all such variations as fall within the scope of the appended claims.

I claim:

1. A fixture comprising:

a mounting plate adapted to be attached by fastener means to a supporting wall;

a post supported by said mounting plate and projecting outwardly therefrom in a predetermined direction away from said wall and which is of non-circular external cross-section transversely of said direction;

a cover plate disposed about said non-circular post outwardly of said mounting plate and having an inner edge defining an opening through which said non-circular post extends;

said opening being larger than said post to fit loosely thereabout in a relation permitting movement of the cover plate transversely of the post and relative to the post and mounting plate, during attachment of the fixture to a wall, and between a first position of the cover plate allowing access to said fastener means by a tool and a second position covering the fastener means; and a part disposed about said post and adapted to bridge across the space between said post and said inner edge of the cover plate and which contains a non-circular opening fitting closely about said non-circular post;

said cover plate being movable relative to said part transversely of the post in moving between said first and second positions.

2. A fixture as recited in claim 1, including means for retaining said cover plate in a position near said mounting plate and covering said fastener means.

3. A fixture as recited in claim 1, including detent means on said cover plate and said mounting plate for retaining said cover plate closely adjacent the mounting plate and in a position covering said fastener means.

4. A fixture as recited in claim 1, in which said cover plate has side walls with inwardly deformed detenting projections engageable with a peripheral edge of said mounting plate in a snap detent relation retaining said cover plate in a position closely adjacent said mounting plate and covering said fastener means.

5. A fixture as recited in claim 1, in which said part has peripheral portions received behind said cover plate and retained thereby against movement away from said mounting plate.

6. A fixture as recited in claim 1, in which said part has opposite edge portions offset relative to the remainder of said part in a direction toward said mounting plate and adapted to be received behind said cover plate and be held in position thereby.

7. A fixture as recited in claim 1, in which said mounting plate and said part have portions engageable with one another in a relation retaining said part against movement rearwardly relative to said mounting plate beyond a predetermined position in the assembled condition of the fixture.

8. A fixture as recited in claim 1, in which said cover plate is engageable rearwardly against said part to hold it against movement away from the mounting plate in the assembled condition of the fixture, said mounting plate having a portion or portions engageable against a rear side of said part in said assembled condition of the fixture to coact with the cover plate in a relation holding said part in fixed position.

9. A fixture as recited in claim 1, in which said post has tabs turned laterally in opposite directions behind said mounting plate.

10. A fixture as recited in claim 1, in which said opening in the cover plate is essentially rectangular, and said part is of an essentially rectangular configuration corresponding generally to said opening.

11. A fixture comprising:

a mounting plate adapted to be received in front of a supporting wall and containing apertures through which screws can extend to attach the plate to the wall;

a post supported by said mounting plate and projecting outwardly therefrom in a predetermined direction away from said wall, and which is of rectangular external cross-section transversely of said direction;

said post extending through and fitting closely within a correspondingly rectangular opening in said mounting plate;

a cover plate disposed about said non-circular post outwardly of said mounting plate and having a front wall with an inner edge defining an opening through which said rectangular post extends;

said opening in said front wall of the mounting plate being larger than said rectangular post to fit loosely thereabout in a relation permitting movement of the cover plate relative to the post and mounting plate, during attachment of the fixture to a wall, between a first position of the cover plate allowing access to one of said screws by a tool, a second position allowing access to the other screw, and a third position covering the screws:

said cover plate having peripheral walls extending rearwardly from said front wall and receivable about said mounting plate, with said walls having inwardly deformed detent lugs resiliently engageable with peripheral edge portions of said mounting plate in a detenting relation holding the cover plate in an assembled position relative to the mounting plate; and a part disposed about said post and containing a rectangular opening fitting the rectangular post closely and adapted to bridge across the space between said post and said inner edge of said front wall of said cover plate;

said part having edge portions received behind said front wall cover plate and held rearwardly thereby in the assembled condition of the fixture;

said mounting plate and said part having portions engaging one another in said assembled condition to coact with said front wall of the mounting plate in holding said part in fixed position.

12. A fixture as recited in claim 11, in which said post has tabs turned laterally behind said mounting plate and confined between the mounting plate and wall.

13. A fixture as recited in claim 12, in which said mounting plate has peripheral detenting portions deformed forwardly and engageable with said detenting lugs of the cover plate to hold the cover plate in assembled condition relative to the mounting plate.

14. A fixture as recited in claim 13, including a structure supported by said post at a location spaced outwardly from said mounting plate and outwardly beyond said cover plate and said part.

15. A fixture as recited in claim 14, in which said opening in said front wall of the cover plate is essentially square, and said part has a portion received within said opening in said front wall of the cover plate and of an essentially square configuration corresponding essentially thereto.

16. A fixture as recited in claim 1, including a structure supported by said post at a location spaced outwardly from said mounting plate and outwardly beyond said cover plate and said part.

17. A fixture as recited in claim 11, in which said engaging portions of said mounting plate and said part include projections on said mounting plate turned forwardly into engagement with said part.

18. A fixture as recited in claim 11, in which said engaging portions of said mounting plate and said part include projections extending rearwardly from opposite sides of said part and engaging said mounting plate.

19. A fixture as recited in claim 1, in which said engaging portions of said mounting plate and said part include projections on said mounting plate turned forwardly into engagement with said part.

20. A fixture as recited in claim 1, in which said engaging portions of said mounting plate and said part include projections extending rearwardly from opposite sides of said part and engaging said mounting plate.

* * * * *